United States Patent [19]

Dougherty et al.

[11] Patent Number: 4,824,412

[45] Date of Patent: Apr. 25, 1989

[54] METHOD FOR MOUNTING A TENSION MASK COLOR CATHODE RAY TUBE

[75] Inventors: Lawrence W. Dougherty, Sleepy Hollow; James R. Fendley, Arlington Heights, both of Ill.

[73] Assignee: Zenith Electronics Corporation, Glenview, Ill.

[21] Appl. No.: 135,118

[22] Filed: Dec. 21, 1987

Related U.S. Application Data

[62] Division of Ser. No. 831,696, Feb. 21, 1986, Pat. No. 4,721,488.

[51] Int. Cl.[4] ..... H01J 9/227

[52] U.S. Cl. ..... 445/45; 430/23; 445/52

[58] Field of Search ..... 445/30, 37, 45, 52; 430/23, 24

[56] References Cited

U.S. PATENT DOCUMENTS

| | | | |
|---|---|---|---|
| 2,625,734 | 1/1953 | Law | 445/4 |
| 3,623,211 | 10/1969 | Zuhlke | 445/45 |
| 3,894,321 | 7/1975 | Moore | 313/402 X |
| 3,995,283 | 11/1976 | Dougherty | 269/908 X |
| 4,605,879 | 8/1986 | Rath | 445/30 |
| 4,704,094 | 11/1987 | Stempfle | 445/30 |
| 4,713,034 | 12/1987 | Lee et al. | 430/23 |
| 4,721,879 | 1/1988 | Palac | 313/408 X |

*Primary Examiner*—Kenneth J. Ramsey

[57] ABSTRACT

Apparatus for use in fabricating the faceplate section of a color cathode ray tube, which faceplate comprises a target surface and a shadow mask foil support frame affixed to and circumscribing the target surface. The apparatus comprises a pedestal having registration affording means associated therewith and a tensioning structure which includes a fixture comprising a pair of collars for clamping the edge of the shadow mask foil to support and maintain the foil taut. An anvil is provided for engaging a peripheral portion of the clamped foil to induce a deflection of the foil and, thereby, a predetermined tension in the foil. A first indexing means effects repeatable registrations between the clamping fixture and the pedestal registration affording means. A second indexing means registrably mounts the faceplate upon the tensing structure with the foil support frame engaging the foil inside the peripheral portion engaged by the anvil to induce an additional deflection of the foil and, thereby, an incremental increase in tension in the foil to establish the foil at a desired final operational tension.

The invention also contemplates a method of fabricating a screened faceplate utilizing the disclosed apparatus.

13 Claims, 2 Drawing Sheets

METHOD FOR MOUNTING A TENSION MASK COLOR CATHODE RAY TUBE

This application is a division of application Ser. No. 831,696 filed 2-21-86, U.S. Pat. No. 4,721,488

BACKGROUND OF THE INVENTION

This invention relates in general to color cathode ray tubes, and in particular to methods of fabricating an envelope section for such a tube. Of equal significance, the invention is concerned with apparatus for use in such fabrication.

In general, a color selection electrode or "shadow mask" is a device which is disposed adjacent the luminescent phosphor screen that forms the target electrode of a color cathode ray tube (CRT), to control the landing pattern of one or more electron beams as they are swept across the screen. The shadow mask achieves color selection by partially shadowing the surface of the screen from scanning electron beams, permitting access to selected elemental phosphor areas by those beams. The choice of a color selection electrode for use in color television cathode ray tubes is, by and large, a choice between a spherical or biradial electrode and a cylindrical electrode tensed upon a heavy spring frame, both types being supported within the tube envelope. The most common type of color selection electrode used in color television receivers today is the conventional curved type.

In color picture tubes utilizing a conventional shadow mask, there is a tendency on the part of the mask to "dome" (localized buckling) in those areas where a scene characterized by very high brightness is depicted. For example, in a scene where a high concentration of white is presented for an extended period of time, when the beams sweep that area of the screen the current in each beam peaks precipitously with an attendant localized heating of the mask. As a result of such a concentration of heat, that area of the mask expands and displaces itself from its original "cold" position to a position in which it does not effect proper masking of the writing electron beams. As a result, color purity is degraded. Moreover, because of its vulnerability to "doming", a conventional mask cannot accommodate the power density that a "doming-resistant" tensed mask can.

The general practice in cathode ray tubes manufactured for use in color television receivers is to position the mask at an assigned location, relative to the phosphor sreen, by suspending it from three preselected points disposed about the periphery of the tube's face panel. This suspension accomodates overall thermal expansion of the mask by causing the mask to be displaced toward the screen from its original position by provision of bimetallic support springs; however, such provision cannot resolve the above-described localized "doming" problem caused by concentrated heating in localized areas of the mask.

Insofar as the use of a tensioned color selection electrode is concerned, the most common use of such an electrode has been in connection with the cylindrical faceplate CRT produced by one color television manufacturer. In that tube, the color selection electrode comprises a grid formed of a multitude of parallel conductors tensed across a spring frame suspended conventionally within the tube. This grid serves to mask the writing beams so that each falls upon its assigned light emitting phosphor.

The mask supporting frame is mechanically stressed, as by compressing it, prior to attaching the shadow mask thereto. Upon release of the compression force, restoration forces in the frame establish tension in the mask. An advantage of utilizing a tensed mask resides in the fact that the mask, while under tension, will not dome. The mask retains its desired configuration during normal operating conditions.

Under extreme tube operating conditions, however, electron bombardment of a tensed mask of the type adverted to above can cause a series of grids of the mask to relax and cause color impurities. A cathode ray tube utilizing a tensed mask of the type adverted to above is described in U.S. Pat. No. 3,638,063.

The color television cathode ray tube in most common usage today employs a faceplate which approximates a section of a large radius sphere. The shadow mask in such a tube, of course, is contoured to match the faceplate. A trend today is toward a flatter faceplate which, in turn, calls for a flatter shadow mask. However, a flat mask is inherently less mechanically stable than a curved mask. Accordingly, to acquire stability, resort is had to a thicker mask, for example, one having a thickness in the order of 10 to 12 mils. This is approximately twice the thickness of a conventional curved mask. However, when resort is had to a 10 to 12 mil mask the aperture etching process is much more difficult. Specifically, in order to prevent aperture limiting of the beam at the outer reaches of the mask, as would be encountered in a 90 degree tube, the apertures have to be etched at an angle to the plane of the mask, rather than etched substantially perpendicular to that plane as is the case for a conventional curved mask. By way of resolving this aperture etching problem, applicant teaches the use of an envelope section for a color television cathode ray tube characterized by a thin, flat, tensed foil which, by virtue of its mounting, is mechanically stable and which is thin enough as to not be afflicted with the aggravated aperture etching problems posed by a thick mask.

ADDITIONAL PRIOR ART

The following listed patents are directed to the attention of the Patent and Trademark Office for evaluation as to their possible relevance to the claimed subject matter. These patents are believed to represent the closest art of which applicants are aware, but applicants make no admission as to whether they constitute "prior art", whether they are, in fact, relevant nor do applicants make any representation as to this art's legal sufficiency or to its priority in time, nor do applicants represent that no better art exists.

U.S. Pat. Nos.:

2,625,734
3,284,655
2,813,213
1,163,495
2,761,990
2,842,696
2,905,845
3,440,469
3,489,966
3,638,063
3,719,848
3,873,874
3,894,321

3,898,508
4,069,567
4,100,451
4,495,472

OBJECTS OF THE INVENTION

Accordingly, it is a general object of the invention to provide an improved envelope faceplate section for a color cathode ray tube.

It is another general object of the invention to provide a method of fabricating such an improved faceplate section.

It is also a general object of the invention to provide apparatus for use in fabricating the improved envelope faceplate section.

It is another object of the invention to provide apparatus for tensing a shadow mask foil and for thereafter utilizing the tensed foil for producing a luminescent screen upon the target surface of a flat faceplate.

It is still another object of the invention to provide shadow mask tensing apparatus having an indexing system that readily permits repeatable registrations with a workpiece station.

DESCRIPTION OF A PREFERRED EMBODIMENT

Figure 1:
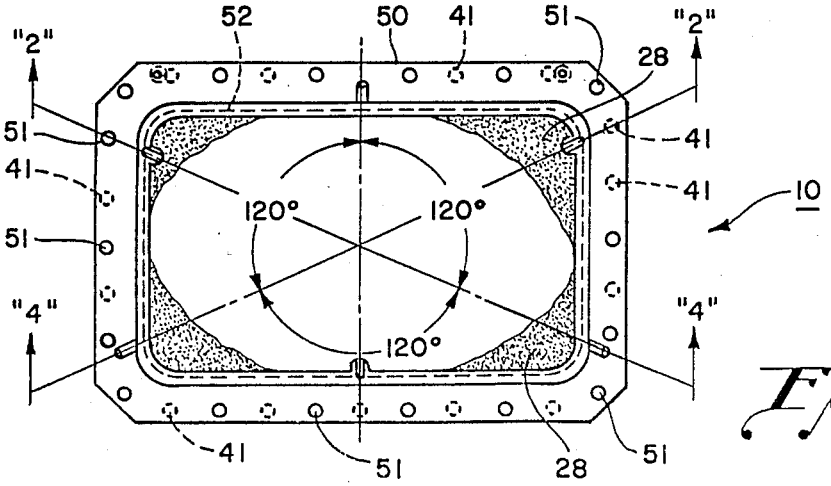
FIG. 1 is a plan view of apparatus for tensing a shadow mask foil as viewed along lines 1—1 in FIG. 2.

The apparatus 10, depicted in plan in FIG. 1 and constructed in accordance with the invention, is utilized in fabricating an envelope section 12 for a color cathode ray tube. As shown in FIG. 2, envelope section 12 comprises a flat faceplate 14 having a target surface 16 and a shadow mask foil support frame 18 affixed to faceplate 14 and circumscribing target surface 16. Frame 18 is formed from a metal alloy which is compatible with the faceplate material and is secured thereto by a frit type glass cement of the kind conventionally employed in the manufacture of cathode ray tubes. Additional information respecting the construction and assembly of frame 18 is disclosed and claimed in copending application Ser. No. 832,556 filed concurrently herewith. Apparatus 10, as well as envelope section 12, are depicted in an exploded format in FIG. 2 to facilitate an understanding of the inventive concept as well as to provide a visualization of the manner in which apparatus 10 and envelope section 12 are cooperatively associated.

To this end apparatus 10 comprises a pedestal 20 which is associated with a work station, for example, a CRT lighthouse apparatus subsequently to be described. Pedestal 20 has registration affording means associated therewith in the form of a plurality of trihedral, or cone shaped, cavities 22 (preferably three), which are angularly spaced 120 degrees, relative to each other, in the horizontal plane and radially aligned to the geometric center of apparatus 10. This apparatus further includes a tensing structure 24 that includes a fixture 26 comprising means for clamping the edge of a shadow mask foil 28 to support and maintain the foil taut. More particularly, fixture 26 comprises first and second juxtaposed collars 30, 32 each having the generally rectangular configuration of the envelope section to be fabricated but being larger in overall span. Each of collars 30, 32 has a respective outwardly directed face 31, 33, as well as respective confronting complementary stepped faces 34, 36, each, in turn, comprising a respective one of the pair of clamping shoulders 35, 37, see FIG. 2A. Collars 30, 32 have substantially coincident central openings 38, 40 which are greater in overall span than target surface 16 of faceplate 14.

Figure 2A:
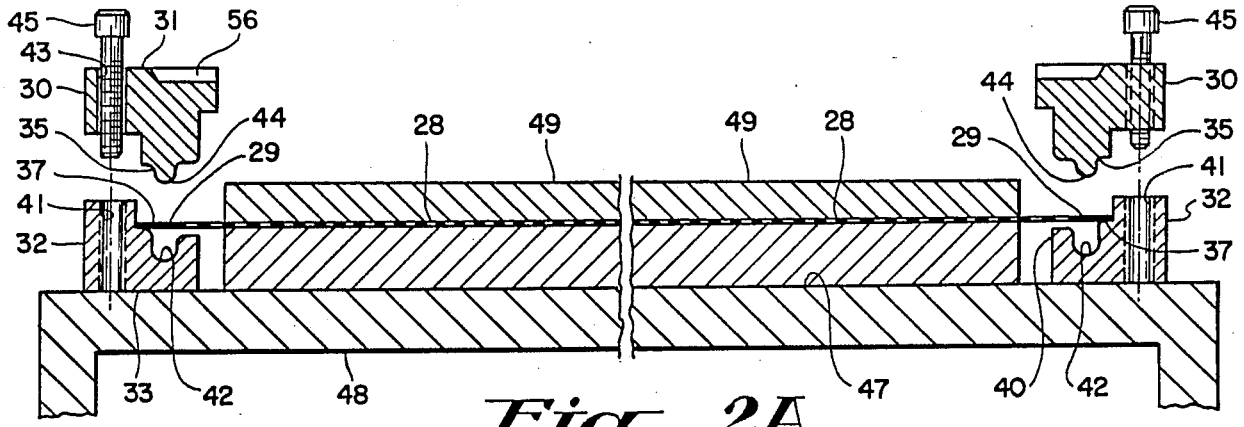
FIG. 2A is an exploded elevational sectioned view of the components of a tensing fixture employed to initially tauten a shadow mask foil.
Figure 2:
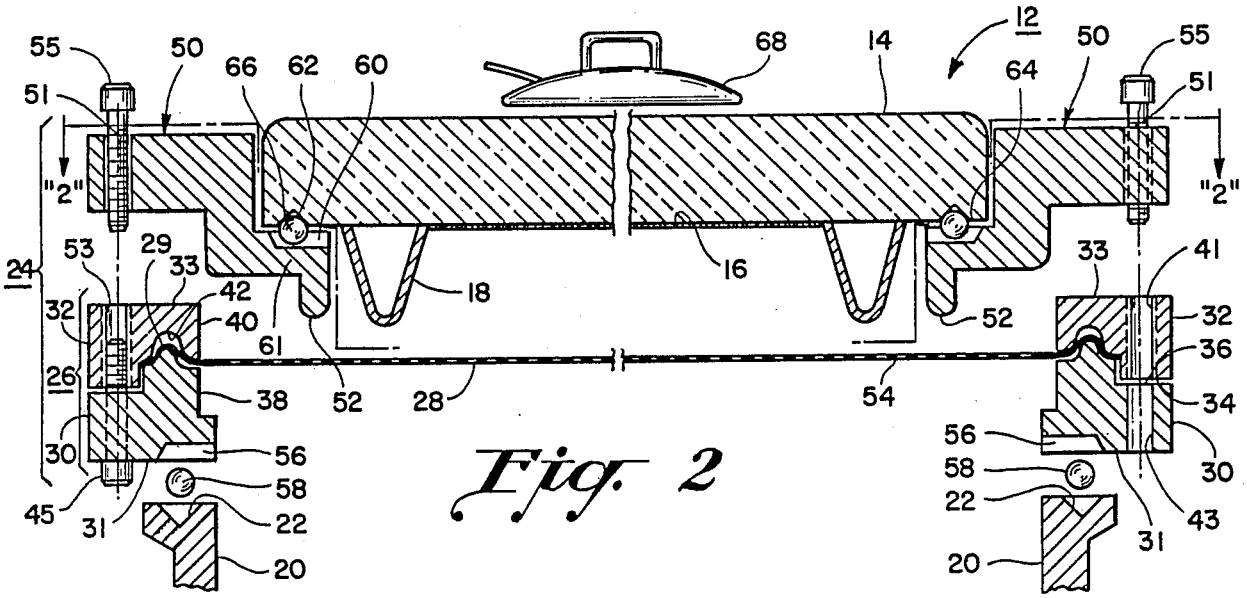
FIG. 2 is an exploded elevational sectioned view of the shadow mask foil tensing apparatus shown in FIG. 1.

Face 36 of collar 32 is relieved to define an endless channel 42 while confronting face 34 of collar 30 comprises an upstanding bead 44 which is configured to be received within channel 42, see FIG. 2A. Bead 44 has an elevation less than the depth of channel 42 so that when shoulders 35, 37 of collar faces 34, 36 are juxtaposed with the peripheral edge 29 of foil 28 sandwiched therebetween, bead 44 drives foil edge 29 into channel 42 thereby tautening the foil as the collar shoulders 35, 37 abut to clamp the foil taut, see FIG. 2.

Collar 32 is provided with a multiplicity of circumferentially disposed tapped bores 41 while collar 30 is, in similar fashion, provided with a like multiplicity of untapped bores 43 which coaxially align with bores 41 when collars 30, 32 are juxtaposed. It is now apparent that the above-mentioned driving of collar bead 44 into collar channel 42 can be readily achieved by inserting a multiplicity of threaded bolts 45 into bores 43 until they engage the threaded walls of bores 41. However, prior to drawing down bolts 45 to effect clamping of foil edge 29, it is desirable that foil 28 be rendered as flat and wrinkle-free as possible.

To this end and with reference to FIG. 2A, prior to the introduction of foil 28 to the clamping fixture 26, a platen 47 having an overall span slightly less than the span of opening 40 in collar 32 is disposed upon a granite surfaced plate 48 which offers a high degree of planarity. Collar 32 is then positioned upon the granite plate with its face 33 in contact therewith and with its opening 38 coaxially enclosing the platen. The thickness of platen 47 (its elevation as viewed in FIG. 2A) is selected so that its upper surface resides in the plane of clamping shoulder 37 on collar 32. Foil 28 is then positioned upon platen 47 with its peripheral edge 29 overlying clamping shoulder 37. A weight 49, dimensioned similar to platen 47, is placed upon foil 28 to render the foil substantially planar and wrinkle-free.

Collar 30 is then positioned upon collar 32 so that their complementary stepped faces adjoin. Bolts 45 are inserted through the bores 43 in collar 30 for introduction into the threaded bores 41 of collar 32. When the bolts are drawn down collar clamping shoulders 35, 37 abut to establish the foil in substantial planarity and in an initial tension.

As shown in FIG. 2, tension structure 24 further includes a generally rectangularly configured anvil ring 50 for engaging a peripheral portion of the clamped foil to induce a deflection of foil 28 and, thereby, a predetermined tension in the foil. For this purpose the anvil means comprises a rounded crown 52 that circumscribes the periphery of the tautened foil 28 and serves to engage a peripheral portion 54 of the clamped foil, inside the clamped edge 29, to induce the aforesaid predetermined tension in the foil, see FIG. 3. Anvil 50 further comprises a plurality of untapped ports 51 which are spaced about the periphery of the anvil and extend there-through to confront a like plurality of tapped ports 53 in collar 32. As shown in FIG. 1, ports 51 on the anvil are so spaced as to not coincide with the tapped bores 41 in collar 32 since bores 41 are employed to clamp collar 32 to collar 30, see FIG. 2A. In any event, anvil ports 51 and collar ports 53 are adapted to receive threaded bolts 55 in order to secure anvil 50 to the clamping fixture 26, see FIG. 3. As best seen in that Figure, when the constituent elements of tensing structure 24 (shown "exploded" in FIG. 2A) are fully assembled, foil 28 is under the aforesaid predetermined tension.

A first indexing means is provided for effecting repeatable registrations between the clamping fixture 26, i.e. collars 30, 32, and the pedestal registration affording cavities 22. This first indexing means can comprise a series of elongated grooves 56 disposed on the outwardly directed face 31 of collar 30 and, matching in number and geometrical location, the cavities 22 on pedestal 20. Desirably, the grooves and cavities adopt the construction described in copending patent application Serial No. (D5286) filed concurrently herewith. The first indexing means further comprises a plurality of spherical elements such as balls 58 individually receivable between an assigned one of cavities 22 in the pedestal and a paired groove 56 in fixture collar 30.

A second indexing means is provided for registerably mounting faceplate 14 upon tensing structure 24 with the foil support frame 18 disposed in a confronting relation to and engaging foil 28 inside the area of contact between anvil shoulder 52 and the foil. The second indexing means can also comprise a groove and ball arrangement in which grooves 60 (preferably three) are formed upon a shelf 61 of anvil 50 while matching trihedral cavities 62 are formed about the peripheral sealing land 64 of faceplate 14. As in the other indexing arrangement, a plurality (three) of balls 66 are utilized to establish repeatable registrations between faceplate 14 and the anvil member 50 of the tensing structure 24. Since a phosphor screening operation, to be described, entails repeated registrations between the faceplate and anvil 50, in order to eliminate the necessity of repeatedly inserting balls 66 between grooves 60 and cavities 62 it is proposed that balls 66 be temporarily secured within the faceplate cavities 62 by an organic adhesive. Specifically, a cement material is selected that readily vaporizes when the screened faceplate is subsequently subjected to an elevated bake-out temperature.

Figure 3:
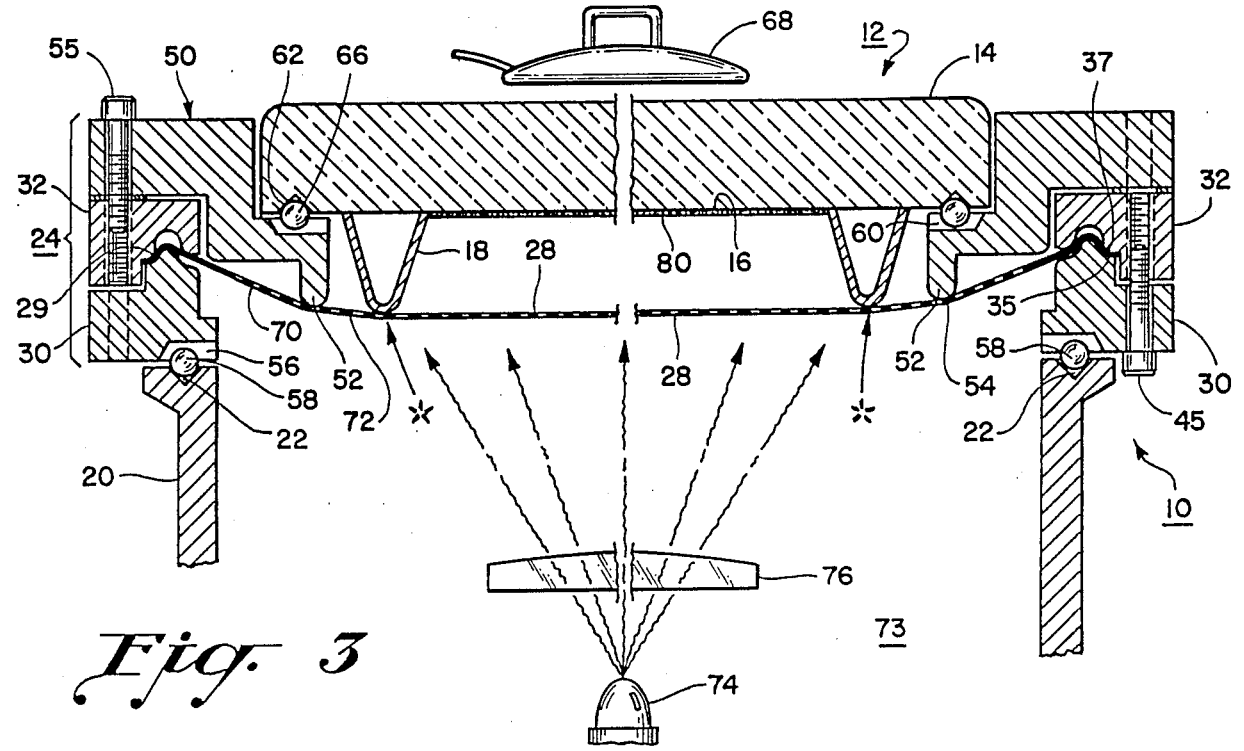
FIG. 3 is an assembled elevational sectioned view of the FIG. 2 apparatus indexed upon a photoscreening lighthouse station.

After the foil is clamped between collars 30, 32 a predetermined initial tension is induced in the foil by mounting anvil 50 atop collar 32 and securing it thereto by bolts 55. This tension is manifested by the deflected portion 70 of the foil between its clamped edge 29 and crown 52 of the anvil. This assembly, which has been designated tensing structure 24 is then indexed upon pedestal 20. As shown in FIG. 3, faceplate 14 is then registered upon anvil 50. The faceplate is readily positioned upon anvil 50 and removed therefrom by recourse to a conventional vacuum chuck 68. The weight of the faceplate now produces an additional deflection 72 of foil 28 between anvil crown 52 and the point where support frame 18 engages the foil. While deflection 72 does induce an incremental increase in tension in the foil which establishes the foil at a final operational tension the principal reason for effecting a positive circumferential engagement between support frame 18 and the foil is to ensure attaining at every location around the perimeter of support frame 18 a substantially constant and precisely repeatable Q spacing between the foil and target surface 16. It is also to be appreciated that the positive circumferential engagement between foil 28 and frame 18 assures that the build-up of any dimensional tolerances in the clamping collars interface, the anvil and any contributed by the indexing arrangements will be accounted for by the displacement of the foil from its undeflected position to its final operating position. This foil/frame engagement also accommodates gradual departures from support frame planarity and/or from anvil crown planarity.

The apparatus above described serves to establish shadow mask foil 28 in a predetermined operational tension so that the foil can be utilized in the fabrication of an envelope section 12 for a color cathode ray tube. Specifically, the foil is established in tension in the following manner. Platen 47 is placed upon a granite faced surface 48 and collar 32 of the clamping fixture is positioned on that surface so as to enclose the platen. A length of apertured shadow mask foil 28, having an overall span such that it extends onto shoulder 37 of collar 32, is placed upon the platen. Collar 30 is then arranged upon collar 32 so that its bead 44 enters channel 42 of collar 32 to urge the edge of foil 28 into that channel. Thereafter, threaded bolts 45 are inserted in assigned collar bores to draw collars 30, 32 together and drive bead 44 into channel 42. This tautening of the foil continues until face 35 of collar 30 abuts face 37 of collar 32. As a result, foil 28 is tautened to an initial tension.

Anvil member 50 is then positioned upon collar 32 and bolts 55 are inserted in their assigned bores to secure the anvil member to the clamping fixture. As the anvil member is tightened, its crown 50 induces deflection 70 in the foil in the fashion graphically depicted in FIG. 3.

In the manner already mentioned, the faceplate 14 is lowered by vacuum chuck 68 until the apex of frame 18 engages foil 28 and, by virtue of its own weight, induces the additional increment of tension in the foil to establishe foil 28 at its operational tension.

There will now be described a process that utilizes tensed foil 28, as a stencil, to screen a pattern of primary color elemental phosphor areas upon the target surface 16 of faceplate 14 to form an envelope section for a color cathode ray tube. A known and widely used method of preparing a color phosphor screen utilizes a process which has devolved from known photographic techniques. To this end, a slurry comprising a quantity of a primary color phosphor particles suspended in a photosensitive organic solution e.g., pva, is applied, as a coating, to the target surface 16 of the faceplate.

The tensing structure 24, with foil 28 clamped in place by collars 30, 32 and established at a predetermined tension by anvil 50, is now registered upon pedestal 20 by utilizing the cavities 22, grooves 56 and balls 58 indexing arrangement described above. Vacuum chuck 68 then positions faceplate 14 over the registered tensing apparatus 24 with the faceplate target surface 16 disposed in a confronting relation to the tensed foil. Faceplate 14 is now registerably mounted upon anvil 50 by recourse to the previously described indexing arrangement comprising grooves 60, cavities 62 and balls 66. In this embodiment frame 18 is permitted to engage foil 28 and thereby induce an incremental additional tension in the foil so that the foil is now established at a desired final operational tension.

As schematically depicted in FIG. 3, pedestal 20 is associated with a photoscreening lighthouse 73 comprising a source of light 74 actinic to the photosensitive coating and a beam trajectory compensating lens 76. This lens serves to compensate for the fact that the trajectory of an electron beam, under deflection, differs from the path of a light ray originating from the same point source as the electron beam. During the screening process, at any one instant, light source 74 occupies the spatial position corresponding, in effect, to the location of the electron beam that will subsequently excite the phosphor pattern to be created. In practice, successive repositioning of the light source, prior to exposing the target surface through the foil, serves to effectively mimic the positions of three scanning electron beams issuing from a gun mount later to be fitted to a tube incorporating the screened faceplate. As a result, the thus formed luminescent screen pattern will bear a unique geometric relationship, or orientation, to the light sources and, thereby, to the electron beam axes of the subsequently fitted electron gun mount.

Desirably, before forming a phosphor screen upon target surface 16 of the faceplate, that surface is provided with the grille reflecting a three-fold replication of the aperture pattern of foil 28. A black matrix grille of this type is frequently employed in a negative guard band tube. This grille can be formed in the following manner. A dichromate sensitized polyvinyl alcohol (pva) solution is coated upon target surface 16. After drying, the coated faceplate is indexed upon pedestal 20 and successively exposed three times through apertured foil 28 by light source 74 with the light source initially occupying a spatial position effectively corresponding to that of the green, for example, beam. The second exposure is taken after the light source is effectively positioned to simulate the source of the blue beam. Finally, for the third exposure, the light source is again repositioned, this time to simulate the source of the red beam. The triple exposed faceplate is then processed in known fashion to develop an aperture pattern on the target surface. In this process, all of the unexposed pva coating is removed leaving three patterns of pva deposits, each pattern corresponding to the aperture pattern in foil 28.

The faceplate target surface is next coated with a colloidal graphite suspension and dried. The target surface is then treated with a hydrogen peroxide solution which strips the pva deposits from the target surface leaving three aperture patterns (the grille) each corresponding to the aperture pattern of the foil. The target surface is now prepared to receive red, green and blue elemental phosphor deposits.

The phosphor screening process is also well known. Suffice it to say that the grille bearing target surface is coated with a phosphor slurry, green, for example, dried and then exposed by the light source positioned to mimic the location of the green beam. As in creating the grille, the light rays are directed by lens 76 and the apertured foil to impinge the green phosphor slurry and create a latent image of the foil aperture pattern thereon. The faceplate is then removed and the target surface washed to remove unexposed slurry. As a result there is established upon target surface 16 a pattern of elemental green phosphor deposits corresponding to the aperture pattern of foil 28.

The slurry coating, faceplate indexing, exposure and wash steps are then repeated for each of the other primary color phosphor areas to be applied to target surface 16, with the source of actinic light, of course, disposed at appropriately different positions with respect to the foil. The resultant luminescent screen 80 comprises a pattern of interweaved primary color elemental phosphor areas corresponding to the aperture pattern in foil 28.

After the screening process has been completed, the screened faceplate is re-indexed upon tensing structure 24 and that assemblage is then transported to and mounted upon a work station, which can comprise a pedestal similar to that associated with lighthouse 73. This work station is associated with a welding operation utilizing, for example, a laser welder, for permanently securing tensed foil 28 to its mounting frame 18. This welding step is graphically depicted by the asterisk-like weld symbols shown in FIG. 3. That portion of the foil outside frame 18 is then trimmed off. The faceplate is then subjected to a bake-out step which vaporizes the adhesive employed for retaining the indexing balls 66 in cavities 62. The now screened faceplate, with foil 28 and its mounting frame in place, comprises an envelope section which is mated to a cathode ray tube funnel by the convention frit sealing process.

Figure 4:
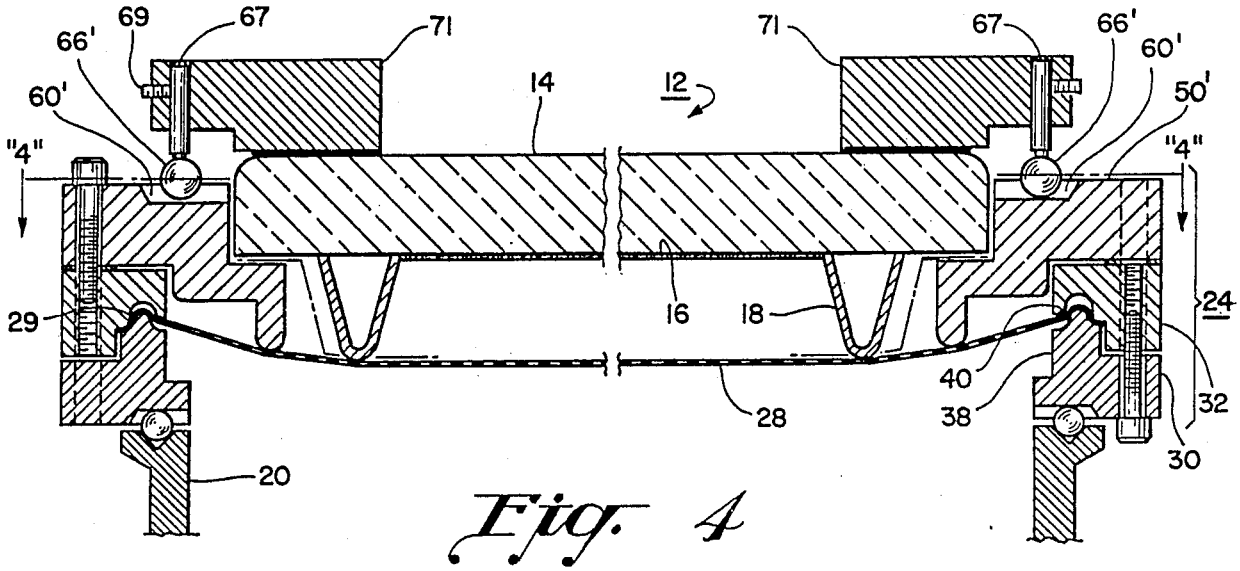
FIG. 4 is an assembled elevational sectioned view of the apparatus shown in FIG. 2, in which an alternate arrangement for registrably mounting the CRT faceplate upon the tensing structure is depicted.
Figure 5:
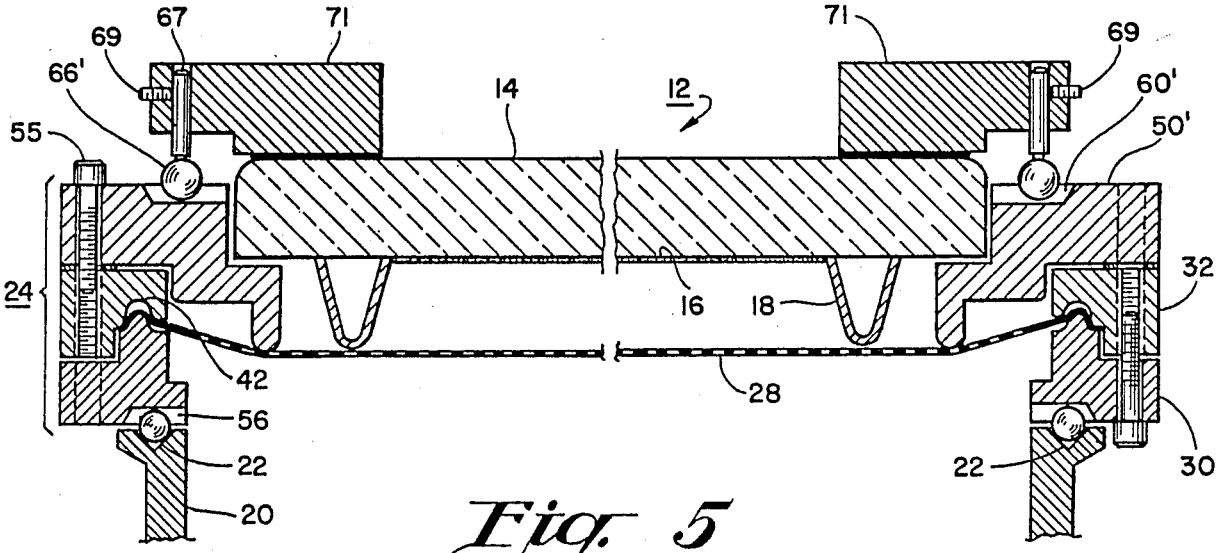
FIG. 5 is another elevational sectioned view of the FIG. 4 apparatus in which the faceplate frame is maintained spaced-apart from the foil during the tensing operation, as well as during the photoscreening process.

In place of the aforesaid second indexing means shown in FIGS. 2 and 3 for registerably mounting faceplate 14 upon tensing apparatus 24 an alternative indexing arrangement is illustrated in FIGS. 4 and 5. More particularly, the alternative arrangement contemplates a somewhat differently configured anvil ring 50' having a plurality (three) of radially oriented grooves 60' formed on the top face of the anvil and desirably spaced apart 120 degrees. Cooperating with grooves 60' are a like plurality (three) of indexing balls 66' individually borne by vertically disposed shafts 67 which, in turn, are adjustably retained, as by set screws 69, in an assigned one of a plurality (three) of blocks 71. Desirably, blocks 71 are temporarily secured, as by an adhesive, to the outside face of faceplate 14. Blocks 71 are spaced apart 120 degrees on the surface of the faceplate so as to position balls 66' in a confronting relation to an assigned one of mating grooves 60'. This temporary indexing arrangement is employed to register the faceplate during the screening operation after which blocks 71 are removed from the faceplate. The now screened faceplate is subjected to the above described wilding operation to secure tensed foil 28 to frame 18 to comprise an envelope section which is then joined to a funnel section to form a color cathode ray tube.

It has been determined that sufficient tension can be induced in foil 28 by the cooperative action of clamping collars 30, 32 and the anvil ring. In that case it would be unnecessary for foil support frame 18 to actually engage foil 28, as it does in FIG. 3. Accordingly, in an alternate embodiment of the invention, as shown in FIG. 5, foil support frame 18 is spaced from foil 28 throughout the area where the frame confronts the foil. This spacing is established and maintained each time the faceplate is indexed upon anvil ring 50'. The exact spacing is selected by adjusting the shafts 67 of the alternative indexing arrangement. At the completion of the screening operation, described above, the gap between foil 28 and frame 18 is filled with metal or other filler to support the foil at the Q-spacing it sustained during the screening operation.

While particular embodiments of the present invention have been shown and described, it will be obvious to those skilled in the art that changes and modifications may be made without departing from the invention in its brosder aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A method of fabricating an envelope section for a color cathode ray tube comprising the following:

providing a flat faceplate having a target surface with a frame on opposed sides of said target surface;

tensing an apertured foil substantially to a predetermined tension in a tensing structure;

effecting relative translation of said faceplate and said tensed foil until said faceplate frame effects a positive displacement of said tensed foil;

effecting an indexing directly between said tensing structure and said faceplate;

fabricating a screen comprising a pattern of elemental phosphor areas including photoexposing, through said tensed foil, a photosensitive coating deposited upon said target surface of said faceplate; and re-indexing said tensing structure and said faceplate and thereafter securing said tensed apertured foil to said faceplate frame in registration with said phosphor areas established on said target surface of said faceplate.

2. A method of fabricating an envelope section for a color cathode ray tube comprising the following:

providing a flat faceplate having a target surface with a frame on opposed sides of said target surface;

tensing an apertured foil substantially to a predetermined tension in a tensing structure;

effecting relative translation of said faceplate and said tensed foil until said faceplate frame effects a positive displacement of said tensed foil;

effecting an indexing directing between said tensing structure and said faceplate;

fabricating a grille reflecting a three-fold replication of the aperture pattern of said apertured foil by a photoexposing, through said foil, of a photosensitive coating deposited upon said target surface of said faceplate;

removing said faceplate from said tensing structure and developing an apertured grille upon said target surface;

fabricating a screen upon said grille bearing target surface comprising a pattern of elemental phosphor areas by effecting relative translation of said faceplate and said tensed foil until said faceplate frame effects a positive displacement of said tensed foil;

effecting a re-indexing directly between said tensing structure and said faceplate with said grille formed on said target surface;

photoexposing, through said tensed foil, a photosensitive phosphor slurry coating deposited upon said target surface of said faceplate;

removing said faceplate from said tensing structure and developing a pattern of elemental phosphor areas in an assigned group of grille apertures;

repeating the preceding procedures for each pattern of elemental phosphor areas desired to be established; and effecting a relative translation of said faceplate and said tensed foil until said faceplate frame effects a positive displacement of said tensed foil, re-indexing said tensing structure and said faceplate and thereafter securing said tensed apertured foil to said faceplate frame in registration with said phosphor areas established on said target surface of said faceplate.

3. A method of fabricating an envelope section for a color cathode ray tube comprising the following:

providing a flat faceplate having a target surface with a separate frame circumscribing said target surface and secured to the inner surface of said faceplate;

providing a tensing structure for tensing an apertured foil sustantially to a predetermined tension;

effecting relative translation of said faceplate and said tensed foil until said faceplate frame effects a positive displacement of said tensed foil;

effecting an indexing directly between said tensing structure and said faceplate;

fabricating a screen comprising a pattern of elemental phosphor areas including photoexposing, through said tensed foil, a photosensitive coating deposited upon said target surface of said faceplate;

repeating the three preceding procedures for each pattern of elemental phosphor areas desired to be established; and re-indexing said tensing structure and said faceplate and thereafter securing said tensed apertured foil to said faceplate frame in registration with said phosphor areas established on said target surface of said faceplate.

4. A method of fabricating an envelope section for a color cathode ray tube comprising the following:

providing a flat faceplate having a target surface with a frame on opposed sides of said target surface;

tensing an apertured foil substantially to a predetermined tension in a tensing structure;

temporarily securing indexing means to either said faceplate or said tensing structure;

effecting relative translation of said faceplate and said tensed foil until said faceplate frame effects a positive displacement of said tensed foil;

effecting an indexing directly between said tensing structure and said faceplate;

fabricating a screen comprising a pattern of elemental phosphor areas including photoexposing, through said tensed foil, a photosensitive coating deposited upon said target surface of said faceplate; and re-indexing said tensing structure and said faceplate and thereafter securing said tensed apertured foil to said faceplate frame in registration with said phosphor areas established on said target surface of said faceplate.

5. A method of fabricating an envelope section for a color cathode ray tube comprising the following:

providing a flat faceplate having a target surface with a discrete metal frame on opposed sides of said target surface;

tensing an apertured foil substantially to a predetermined tension in a tensing structure;

effecting relative translation of said faceplate and said tensed foil until said faceplate frame effects a positive displacement of said tensed foil;

effecting an indexing directly between said tensing structure and said faceplate;

fabricating a screen comprising a pattern of elemental phosphor areas including photoexposing, through said tensed foil, a photosensitive coating deposited upon said target surface of said faceplate; and re-indexing said tensing structure and said faceplate and thereafter welding said tensed apertured foil to said faceplate frame in registration with said phosphor areas established on said target surface of said faceplate.

6. The method of fabricating the envelope section of a color cathode ray tube as set forth in claim 1 which further includes the step of positioning a platen adjacent said foil to maintain said foil planar and in which said predetermined tension is effected by clamping the periphery of said foil and thereafter effecting a positive displacement of said initially tensed foil.

7. A method of fabricating an envelope section for a color cathode ray tube comprising the following:

providing a flat faceplate having a target surface with a frame circumscribing said target surface;

providing a tensing structure for tensing an apertured foil substantially to a predetermined tension;

temporarily securing indexing means to either said faceplate or said tensing structure;

effecting relative translation of said faceplate and said tensed foil until said faceplate target surface is disposed in a confronting relation to said tensed foil;

effecting an indexing directly between said tensing structure and said faceplate;

fabricating a screen comprising a pattern of elemental phosphor areas including photoexposing, through said tensed foil, a photosensitive coating deposited upon said target surface of said faceplate;

repeating the three preceding procedures for each pattern of elemental phosphor areas desired to be established;

re-indexing said tensing structure and said faceplate and thereafter securing said tensed apertured foil to said faceplate frame in registration with said phosphor areas established on said target surface of said faceplate;

in which said predetermined tension in said foil is effected by clamping the periphery of said foil and effecting a positive displacement of said foil by translating a member of said tensing structure into engagement with said clamped foil;

in which an incremental tension is thereafter induced in said tensed foil by translating said faceplate until said faceplate frame encounters the same side of said tensed foil as is engaged by said tensing structure member to effect a second positive displacement of said tensed foil, and in which said faceplate is provided with grooves and rounded elements are coupled to said tensing structure to effect an indexing between said faceplate and said tensing structure.

8. A method of fabricating an envelope section for a color cathode ray tube comprising the following:

providing a flat faceplate having a target surface with a separate frame on opposed sides of said target surface and secured to the inner surface of said faceplate;

tensing an apertured foil substantially to a predetermined tension in a tensing structure;

effecting relative translation of said faceplate and said tensed foil until said faceplate frame effects a positive displacement of said tensed foil; and effecting an indexing directly between said tensing structure and said faceplate.

9. for use in the fabrication of an envelope section for a color cathode ray tube having a tensed foil shadow mask, a method comprising:

providing a flat faceplate and registration-affording means associated therewith, said faceplate having a central screening area;

securing on opposed sides of said screening area, shadow-mask supporting means having a mask-receiving surface;

supporting an apertured metal foil mask in a tension structure having indexing means for registration with said registration-affording means associated with said faceplate;

photoscreening a series of phosphor deposits on said screening area using said apertured foil as an exposure master, including registering by said registration-affording means and said indexing means said tension structure and thus said mask with said faceplate, and urging said foil into intimate contact with said mask-receiving surface during photoexposure of said screening area constituting part of said photoscreening; and securing said foil to said mask-receiving surface.

10. The method according to claim 9 wherein said registration-affording means provides for positioning said tension structure in a plane whose location is effective to cause said mask to be in intimate contact with said mask-receiving surface at all points of the interface therebetween.

11. For use in the fabrication of an envelope section for a color cathode ray tube having a tensed foil shadow mask, a method comprising:

providing a flat faceplate and registration-affording means associated therewith, said faceplate having a central screening area;

securing on opposed sides of said screening area, shadow-mask supporting means having a mask-receiving surface;

supporting an apertured metal foil mask in a tension structure having indexing means for registration with said registration-affording means associated with said faceplate;

photoscreening a serise of phosphor deposits on said screening area using said apertured foil as an exposure master, including registering by said registration-affording means and said indexing means said tension structure and thus said mask with said faceplate, said registration-affording means providing for positioning said tension structure in a plane whose location is effective to cause said mask to be in intimate contact with said mask-receiving surface at all points of the interface therebeteen during photoexposure of said screening area constituting part of said photoscreening; and securing said foil to said mask-receiving surface.

12. For use in the fabrication of an envelope section for a color cathode ray tube having a tensed foil shadow mask, a method comprising:

providing a flat faceplate having a centrally located phosphor screen with a predetermined pattern of phosphor deposits thereon;

securing on opposed sides of said screening area, shadow-mask supporting means having a mask-receiving surface;

supporting an apertured metal foil mask in a tension structure;

positioning said tensioning structure and thus said mask and its apertures such that said apertures are in registration with said predetermined pattern of phosphor deposits;

urging said foil into intimate contact with said mask-receiving surface;

securing said foil to said mask-receiving surface.

13. For use in the fabrication of an envelope section for a color cathode ray tube having a tensed foil shadow mask, a method comprising:

providing a flat faceplate having a centrally located phosphor screen with a predetermined pattern of phosphor deposits thereon;

securing on opposed sides of said screening area, shadow-mask supporting means having a mask-receiving surface;

supporting an apertured metal foil mask in a tension structure, and positioning said tension structure in a plane whose location is effective to cause said mask to be in intimate contact with said mask-receiving surface at all points of the interface therebetween;

positioning said tensioning structure and thus said mask and its apertures such that said apertures are in registration with said predetermined pattern of phosphor deposits;

securing said foil to said mask-receiving surface.

* * * * *